US006408471B1

(12) United States Patent
Teran et al.

(10) Patent No.: US 6,408,471 B1
(45) Date of Patent: Jun. 25, 2002

(54) APPARATUS FOR TREATMENT OF LAUNDRY WITH OZONE

(75) Inventors: Alfredo J. Teran, Cape Canaveral; Richard G. Wood, Merritt Island; Nidal A. Samad, Merritt Island; Carlos V. Diaz, Merrit Island; Timothy N. Tyndall, Cape Canaveral; John R. Derrick, Rockledge, all of FL (US)

(73) Assignee: Agrimond L.L.C., Cape Canaveral, FL (US)

( * ) Notice: Subject to any disclaimer, the term of this patent is extended or adjusted under 35 U.S.C. 154(b) by 0 days.

(21) Appl. No.: 09/682,112

(22) Filed: Jul. 23, 2001

Related U.S. Application Data

(62) Division of application No. 09/394,314, filed on Sep. 10, 1999.

(60) Provisional application No. 60/100,002, filed on Sep. 11, 1998.

(51) Int. Cl.[7] ..... D06F 39/08

(52) U.S. Cl. ..... 8/158; 68/13 R; 68/183; 68/207

(58) Field of Search ..... 8/158; 68/13 R, 68/183, 207

(56) References Cited

U.S. PATENT DOCUMENTS 5,625,915 A * 5/1997 Radler et al. ..... 68/207 X
5,806,120 A * 9/1998 McEachern ..... 68/207 X

* cited by examiner

*Primary Examiner*—Philip Coe
(74) *Attorney, Agent, or Firm*—Anton J. Hopen; Smith & Hopen, P.A.

(57) ABSTRACT

A treatment apparatus and method that greatly increases the efficiency and flexibility in using ozone in the laundry process by permitting an operator to set the level of dissolved ozone concentration delivered to the washing machines, depending upon the amount and type of soil on the laundry. Furthermore, the present invention ensures that there is enough dissolved ozone available in the wash water to meet the demand of the washing apparatus. Lastly, the present invention monitors and maintains the desired amount of dissolved ozone to be delivered to the washers.

7 Claims, 3 Drawing Sheets

APPARATUS FOR TREATMENT OF LAUNDRY WITH OZONE

CROSS-REFERENCE TO RELATED APPLICATIONS

This application is a divisional application under 37 C.F.R. 1.53(b) of U.S. application Ser. No. 09/394,314, filed Sep. 10, 1999, which claims the benefit of Provisional Application Ser. No. 60/100,002 filed Sep. 11, 1998.

BACKGROUND OF THE INVENTION

This invention relates to an apparatus and method for treatment of laundry with ozone, and more particularly, to a variable system for treatment of laundry that is capable of delivering different measured amounts of dissolved ozone concentrations to multiple washing machines.

DESCRIPTION OF THE BACKGROUND ART

Commercial laundry facilities consume large amounts of chemicals, energy and water during wash cycles. Additionally, a byproduct of commercial laundry facilities is generation of wastewater that must be monitored and treated prior to disposal. A typical laundry facility may consist of multiple single washing machines or continuous load washers (i.e., tunnel washers), or a combination thereof. By way of example, a "typical" commercial laundry facility may include multiple single washing machines that 2 may be from 50 to 600-pound capacity. If a laundry facility consists of four 600-pound and two 100-pound single washers, the yearly production of the facility based on three shifts a day may exceed 12 million pounds. The type of laundry or laundry processed may include, but is not limited to, white and colored towels and bed linens, table clothes, bath mats, blankets and medical supplies. Generally, the type of laundry processed imposes a specific chemical formula that ordinarily includes one or more of the following: detergent, alkali, bleach, anti-bleach, sour and fabric softener. There are generally several filling and draining cycles associated with each wash cycle. If it is necessary to treat for impurities (i.e., filtration of lint) and/or adjust the pH of the wash wastewater prior to disposal, additional chemicals such as sulfuric acid and sodium hydroxide may be required.

There presently exist many types of apparatus and method to treat laundry and wash wastewater with ozone. Ozone may be used to substitute for or to augment detergent use since ozone is a powerful bleaching and oxidizing agent. Utilization of ozone in the laundry process can reduce energy consumption since no hot water is required, save or eliminate chemicals which are potentially harmful to the environment, reduce water consumption and reduce wastewater generation. Consequently, use of ozone in the laundry process can even reduce the time required to wash a load of laundry and therefore reducing the labor and energy costs. The production of ozone is well-known in the art and is typically produced using either air or concentrated oxygen. 3However, prior approaches to treat laundry and wash wastewater with ozone have had limited commercial success for a variety of reasons.

By way of example, previous approaches of laundry ozone systems may inject wash water that is pumped out of a washer, including detergent, with ozone and then pump the wash water back into the washer for the duration of the wash cycle. There are several disadvantages to this approach. First, the detergent present in the wash water will consume the injected ozone almost instantaneously. Secondly, the ozone generator must work full time. Third, there is no mechanism to monitor the amount of ozone that is actually dissolved in the wash water to ensure that the laundry receives a preset level of ozone per wash cycle.

A second approach common in the prior art is for the used wash water to be collected in a tank (typically after it goes through a filtration process or is being recycled). The wash water is then circulated within the tank in which ozone is injected then pumped to the washers" supply tank to maintain water levels. The disadvantage of this approach is the washer may receive inadequately ozonated wash water.

A third approach common in the prior art is to inject generated ozone directly into the washer after the washer is filled with water. The washer typically controls the ozone generator such that when the washer starts, it will activate the ozone generator and the ozone generator will start producing and introducing ozone directly into the washer. A disadvantage of this approach is that modification of the washer is necessary to incorporate a gas feed line into the tub of the washer. Additionally, not all washing machines (i.e., tunnel washers) can be readily modified with gas lines or would require a plurality of ozone gas feed lines.

In summary, previous attempts or teachings for washing laundry with ozone have not provided a mechanism by which there is sufficient dissolved ozone available in the wash water to meet the demand of the soiled laundry. Specifically, previous systems typically furnish low levels of ozone. More particularly, they do not provide sufficient means for dissolving ozone into the wash water. Thus, ozone gas is introduced into the ambient environment where it represents a safety hazard. Nor have previous methods or apparatus provided a mechanism by which an operator may set and adjust the level of dissolved ozone to match the demand of the laundry. Prior art systems provide no control over the concentration of ozone, no means by which an operator can readily ascertain how much ozone is delivered and provide no indication as to whether or not the delivered ozone is consumed by the ozone demand contaminant(s).

Continuing efforts are being made to improve laundry and laundry wastewater apparatus and methods. By way of example, note U.S. Pat. No. 5,493,743 to Schneider et al. and U.S Pat. Nos. 5,241,720, 5,181,399 and 5, 097,556 to Engel et al. U.S Pat. No. 5,493,743 discloses an apparatus and method for ozone assisted laundry washing and a wastewater treatment system which preferably is a "closed loop" system which incorporates a process of tiered filtration whereby spent wash water may be collected, filtered and reused. The apparatus and method of Schneider et al. does not teach a mechanism by which an operator may readily select the level of dissolved ozone, and different concentrations of dissolved ozone may be delivered to multiple washing machines. Similarly, U.S. Pat. Nos. 5,241,720, 5,181,399 and 5,097,556 to Engel et al. teach non-adjustable closed loop systems. These patents disclose the addition of ozone to the wash water prior to use in a washing machine. The disclosure and teachings of these patents are incorporated herein by reference in their entirety. U.S. Pat. No. 5,625,915 to Radler et al. discloses a complex laundry ozone injection system that utilizes an ozone manifold with a plurality of manifold outlets to deliver ozone. This patent discloses the steps of allowing the water to be pumped out of the washer, injected with ozone, and pumped back into the washer. The disclosure of this patent is hereby incorporated by reference in its entirety.

U.S. Pat. No. 5,409,616 to Garbutt et al. discloses a gray water reclamation system to treat and restore cleaning water in a closed loop, recyclable water system.

Another grouping of background patents are those which disclose treatment of wash wastewater. By way of example, see U.S. Pat. No. 5,787,537 to Mannillo which teaches a method to treat wastewater in a closed loop wash system where ozone is used for purification of the water but not for the actual laundry cleaning process. Ozone is removed by ultraviolet light prior to the water being used to actually clean laundry. Another grouping of background patents are those which disclose modifications to washing machines or filtration devices. Note U.S. Pat. No. 5,653,129 to Jang that discloses a mechanism by which ozone may be injected directly into the washing means. See also U.S. Pat. No. 5,765,403 to Lincoln et al.; U.S. Pat. No. 5,374,356 to Miller et al.; and U.S. Pat. No. 5,645,608 to Cooper et al. of the water but not for the actual laundry cleaning process. Ozone is removed by ultraviolet light prior to the water being used to actually clean laundry.6Another grouping of background patents are those which disclose modifications to washing machines or filtration devices. Note U.S. Pat. No. 5,653,129 to Gang that discloses a mechanism by which ozone may be injected directly into the washing means. See also U.S. Pat. No. 5,765,403 to Lincoln et al.; U.S. Pat. No. 5,374,356 to Miller et al.; and U.S. Pat. No. 5,645,608 to Cooper et al.

Another grouping of background patents are those which disclose water formulations. Note U.S. Pat. No. 5,763,382 to Cooper et al. and U.S. Pat. No. 5,511,264 to Nishioka et al.

Not withstanding the existence of such prior art laundry apparatus and methods, there is a need for an improved and more efficient apparatus and method for the treatment of laundry that will achieve the requisite level of cleaning without having deleterious effects on the environment.

Therefore, it is an object of this invention to provide an improvement that overcomes the aforementioned inadequacies of the prior art devices and provides an improvement that is a significant contribution to the advancement of the laundry art.

It is an object of the present invention to provide a laundry treatment apparatus and method which permits the introduction of high levels of dissolved ozone (greater than 1.0 PPM) into the wash water.

It is an object of the present invention to increase the efficiency and flexibility of the utilization of ozone in the laundry process and permit an operator to set the concentration level of dissolved ozone concentration delivered to the washing machines. Furthermore, the laundry treatment apparatus and method of the present invention can deliver multiple concentration levels of ozonated water to different washing machines concurrently.7Another object of this invention is to provide a laundry treatment apparatus and method that is self-monitoring and maintains the selected level of dissolved ozone for delivery to the washing machines.

Another object of this invention is to provide a laundry treatment apparatus and method which eliminates the need for chemicals and additives such as bleach, Anti-Chlor (anti-bleach), sour and fabric softener.

Another object of this invention is to provide a laundry treatment apparatus and method that greatly reduces the amount of detergent and alkali used in the laundry process.

Another object of this invention is to provide a laundry treatment apparatus and method that greatly reduces the amount of water usage.

Another object of this invention is to provide a laundry treatment apparatus and method that greatly reduces labor and energy costs thereby increasing productivity due to reduction in wash cycle time.

Another object of this invention is to provide a laundry treatment apparatus and method that permits flexibility in setting the desired dissolved ozone concentration and maintains the desired concentration continually so long as the system is in operation.

Another object of this invention is to provide a laundry treatment apparatus and method that is capable of attaining a higher or lower level of dissolved ozone upon adjustment in a matter of minutes.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF INVENTION

For the purpose of summarizing this invention, this invention comprises a treatment apparatus and method that greatly increases the efficiency and flexibility in using ozone in the laundry process by permitting an operator to set the level of dissolved ozone concentration delivered to the washing machines, depending upon the amount and type of soil on the laundry. Furthermore, the present invention ensures that there is enough dissolved ozone available in the wash water to meet the demand of the washing apparatus. Lastly, the present invention monitors and maintains the desired amount of dissolved ozone to be delivered to the washers.

As used herein, the term "laundry" means all washable fabrics and items. The apparatus and method of the present invention is drawn to an apparatus that incorporates an ozone generator that serves as a water purification means. The term "ozone system" or "water purification means" includes an ozone generator and all necessary equipment for dissolving the generated ozone into the wash water, including but not limited to contact columns, circulations pumps, and the like. The novel apparatus further includes a supply tank and a transfer tank in fluid communication with multiple washing machines. The dissolved ozone level is monitored and controlled at a set point in the supply tank while the oxidation reduction potential (ORP) is monitored and controlled in the transfer tank. In operation, the apparatus of the present invention monitors the water levels in the supply and transfer tanks and automatically fills both tanks to the proper level and maintains the tanks full. When the tanks are full, the water in the supply tank is circulated between the supply tank and the ozone system until the desired ozone set point is reached. At this point, the water in the transfer tank is circulated until the ORP set point is reached. When both control parameters are reached, the ozone system automatically shuts off. The system automatically turns on and the cycle is repeated when the water level in the supply tank drops or the ozone level in either tank drops. A feed pump, independent of the ozone system circulation loop, provides ozonated water (at the predetermined ozone level) to the washers on demand. More specifically, when the apparatus of the present mechanism senses a water demand, ozonated water is supplied from the supply tank to the washer(s) and pre-treated water from the transfer tank is pumped to the supply tank. The method of the present invention continues automatically as long as there is a demand for water or ozone in either the supply or transfer tank.

The key to successfully utilizing ozone in the laundry process is to ensure sufficient dissolved ozone in the wash water to meet demand from the washing machine or machines. It is not sufficient to simply generate "more" or higher levels of ozone gas. It is necessary to ensure that the ozone goes into solution and is maintained at a constant concentration. The apparatus and method of the present invention permits flexibility in setting the desired dissolved ozone concentration and permits the simultaneous delivery of different dissolved ozone concentrations to multiple washers. Once the operator sets the desired concentration, it is maintained continually by the system as long as the system is in operation. If for some reason the operator needs to adjust to a higher or lower level of dissolved ozone, it is done readily and the system achieves the new dissolved ozone concentration in a matter of minutes. Via a control system, preferably a programmable logic controller (PLC), the present invention provides the ability to continuously monitor the concentration of the dissolved ozone being delivered to the washing machine(s). As a safety feature, in use the apparatus and method of the present invention deactivates the washing machine's supply pump if the concentration of dissolved ozone is below the operator's set point.

The present apparatus and method greatly reduces the amount of detergent and alkali necessary to clean even the most soiled laundry. Based upon initial pilot study information, no hot water is required to operate the laundry apparatus, and detergent usage is reduced on average of up to 70%. Consequently, the number of required rinses is reduced by up to 40% which results in a 35–40% water/sewer savings. The reduction in the number of required rinses also reduces the duration of the wash cycle between 30–40%. Additionally, based upon initial pilot study information, the present apparatus and system completely eliminates the need for pH adjustment of the waste water generated by the washing process.

The foregoing has outlined rather broadly the more pertinent and important features of the present invention in order that the detailed description of the invention which follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF DRAWINGS

For a fuller understanding of the nature and objects of the invention, reference should be had to the following detailed description taken in connection with the accompanying drawings in which.

DETAILED DESCRIPTION

Figure 1:
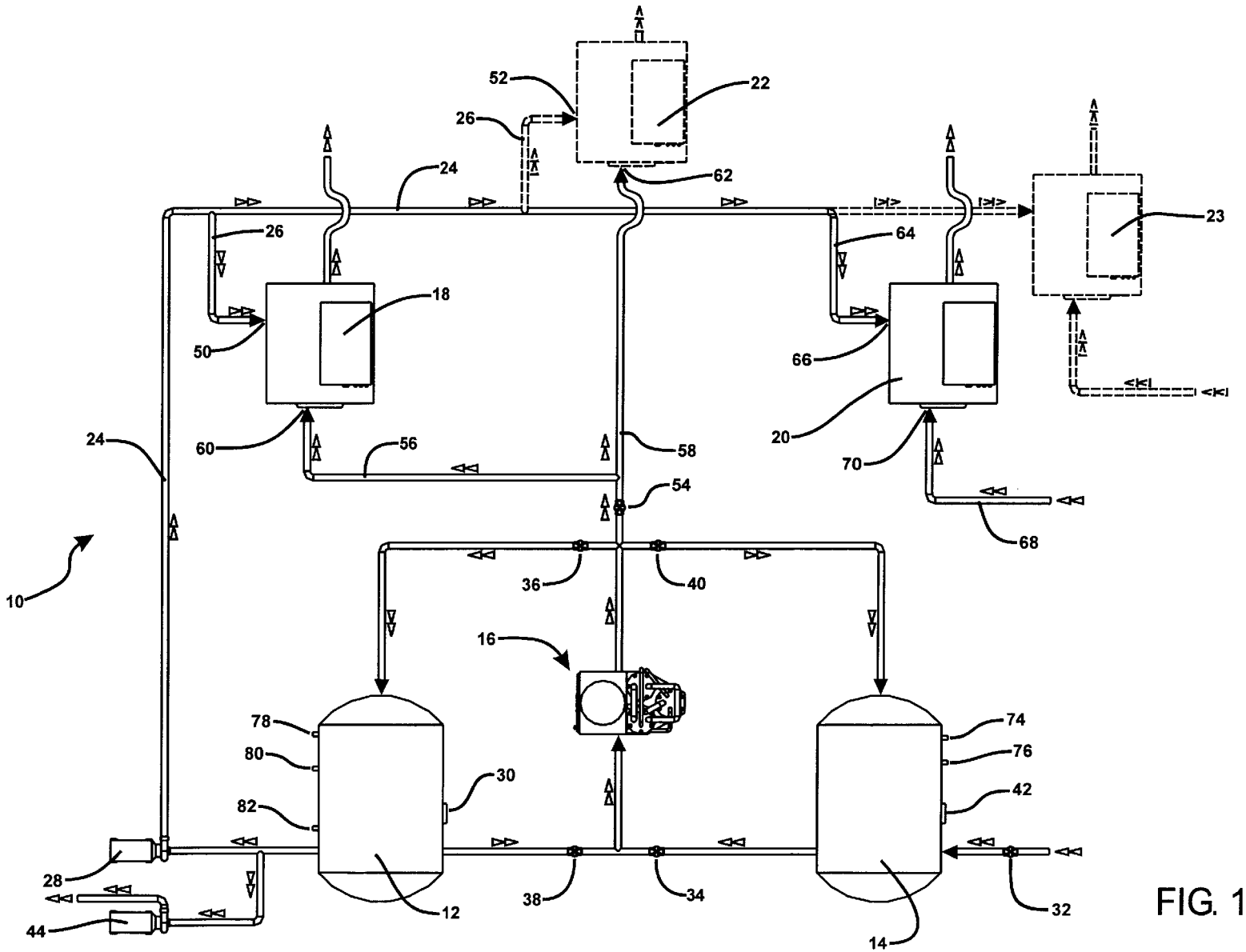
FIG. 1 is a flow diagram illustrating the laundry treatment apparatus and method of the present invention.
Figure 2:
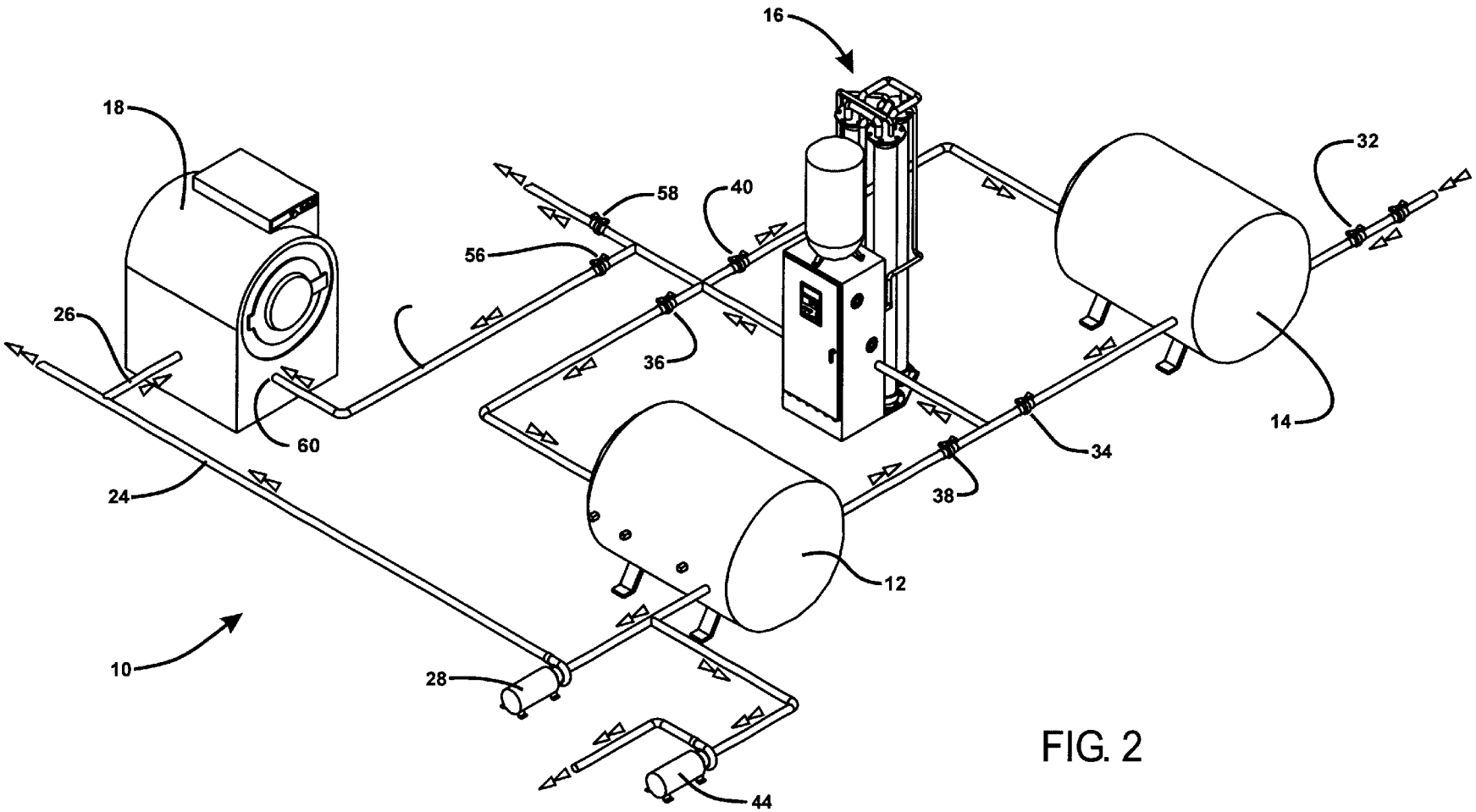
FIG. 2 is a schematic illustration of the laundry treatment apparatus and method of the present invention; an FIG. 3 is an illustration of a preferred ozone system that may be incorporated into the laundry treatment apparatus of the present invention. Similar reference characters refer to similar parts throughout the several views of the drawings.

With reference to the drawings, and in particular FIGS. 1 and 2, a new and improved laundry treatment apparatus and method embodying the principles and concepts of the present invention and generally designated by the reference number 10 will be described.

It is desirable for an operator of a laundry facility to have the ability to set the desired level of dissolved ozone in the wash water and have the ability to deliver different levels of dissolved ozone in the wash water to different washes simultaneously. The amount of dissolved ozone that is required in the wash water to clean laundry is dependent upon the amount and type of soil on the laundry. By way of example, and in no way intended to limit the scope of the present invention, it may be desirable to set the dissolved ozone concentration to a low level (i.e., 1.0 PPM) for colored laundry while maintaining the ability to deliver a medium level (i.e., 2.0–3.0 PPM) of dissolved ozone to a washer for normal soiled laundry and a high level (greater than 4.5 PPM) of dissolved ozone to a washer for stained or heavily soiled laundry.

Key to the present invention is the ability to ensure that ozone goes into solution and that a constant level of dissolved ozone is available to meet the demand of the washer(s). Any commercially available ozone machine or system may be used in-line in association with the system of the present invention, provided it can attain target purification and mass transfer requirements. However, in a preferred embodiment, the ozone system utilized as the water purification means is an AJT $Tech_2$ Ozone machine as disclosed and typified in U.S. Pat. No. 5,785,864 to Teran et al. and U.S. application 09/123,015, the disclosures of which are incorporated herein their entirety by reference. The preferred ozone system will be discussed in greater detail below.

As shown in FIGS. 1 and 2, the apparatus of the present invention includes a plurality of tanks 12, 14 and at least one ozone system that incorporates an ozone system 16 in fluid communication with one another and with one or a plurality of washing means 18, 20. Preferably the washing means is a washing machine. Each tank includes at least one water inlet and one water outlet. One skilled in the art can readily add additional washers 22 and 23 to the apparatus. As used herein, washing machines or washers mean larger capacity machines than those found in a typical home and suitable for use in a commercial laundry facility, laundromat or hotel. The washing machines may be single load washers or tunnel washers. Tunnel washers are continuous washing machines that incorporate multiple pockets whereby, at set intervals, laundry is introduced into the tunnel washer while the same amount of laundry exits the tunnel washer. Laundry typically is retained in each pocket for about two minutes while water is fed into the tunnel washer at different locations. Typically, the laundry and water travel counter to each other.

Each washing machine is capable of being operated independently and is in fluid communication with ozonated wash water from supply tank 12 via supply conduits 24 and 26. If converting a washing machine from chemical operation to ozone operation, the hot and cold water valves are closed. Any commercially available tank, such as those sold by Chemical Containers, Inc., may be used.

Preferably, the apparatus and method of the present invention are monitored and controlled via a control system (not shown) that utilizes a programmable logic controller (PLC), which incorporates use of in-line analytical instrumentation for remote access. However, it should be understood that the control system could also include relay breakers, manual valve operation, or a computer software system. Any commercially available PLC such as those sold under the trademark PLCDirect™, by PLCDirect[\T], Incorporated or by Agrimond, L.L.C. of Cape Canaveral, Fla., may be used in the present application.

Generally speaking, three parameters may be used in controlling the apparatus and method of the present invention. These parameters are, in preferred priority, (1) the water level in the supply tank 12, (2) the dissolved ozone concentration of the water in the supply tank 12 and (3) the oxidation-reduction potential (ORP) of the water in the transfer tank 14. An operator of the present invention can program the system and PLC to set the operation of the apparatus of the present invention based upon the above parameters.

Depending on how an operator programs the PLC, the following steps occur upon activation of the apparatus and method of the present invention to ensure there is adequate ozonated wash water, with the appropriate level of dissolved ozone, immediately available upon demand to the washer(s). In a preferred approach, water is first pumped by a pump (not shown) from transfer tank 14 to supply tank 12 after ozonation in the ozone system 16. Second, the water in supply tank 12 is circulated through ozone system 16 back to supply tank 12. Third, water in transfer tank 14 is circulated through ozone system 16 back to transfer tank 14. Preferably the ozone system of the present invention incorporates a pump means that maintains the level of water in the supply tank and circulates water through the ozone system.

In initial start up, water from a water supply (usually city water, not shown) is pumped through a first valve 32 via a water conduit to fill transfer tank 14 and supply tank 12 via actuated valve 34 and valve 36. After initial start-up, assuming both tanks 12 and 14 are full, which should always be the case upon initiation of the laundry treatment system of the present invention, the first system step is completed. The PLC then detects the dissolved ozone concentration in supply tank 12 through use of a dissolved ozone monitor 30. Preferably, dissolved ozone monitor 30 is situated at the bottom of the tank by the supply pump intake. The dissolved ozone monitor is capable of reading dissolved ozone concentrations up to at least 20 PPM. If the concentration of dissolved ozone is below the desired level set by the laundry operator, then valves 38 and 36 are activated, whereby water in supply tank 12 is circulated through ozone system 16. The water circulates from supply tank 12 to ozone system 16 and back to the supply tank unit 1 the desired dissolved ozone concentration is attained. Once the water in supply tank 12 reaches the desired dissolved ozone concentration, it is ready to be used as wash water. The PLC checks the ORP level, via an ORP monitor 42, in transfer tank 14. If the ORP is below the desired level set by the operator, then the water in transfer tank 14 is circulated through the ozone system 16 via valves 34 and 40. Water from the transfer tank continually circulates from the transfer tank to the ozone system and back to the transfer tank until the ORP set point is satisfied. It is desirable to "pre-treat" the water in the transfer tank to reduce the ozone demand in the water and build up ozone levels. To increase the efficiency of the apparatus and method of the present invention, the dissolved ozone concentration or oxidation reduction potential of the water in transfer tank 14 is preferably in the range of 0.5 to 1.0 PPM (ORP of 800 to 1000 mV).

It should be well understood by one skilled in the art that a dissolved ozone monitor may be used instead of an ORP in the transfer tank or, alternatively, an ORP is not required in the transfer tank, though it is preferable. Use of an ORP in the transfer tank 14 helps an operator determine when the water in the in the transfer tank is "pre-treated" or "pre-ozonated" (typically an ORP of greater than 800 mV) and aids in troubleshooting.

When ozone is first injected into the water before it starts to build any residual ozone, all the ozone consuming contaminants should be destroyed. Therefore, when water is transferred from the transfer tank to the supply tank, it will not require a long period of time for the water in the supply tank to achieve the preset dissolved ozone concentration thereby increasing the efficiency of the apparatus.

While the water in the transfer tank is being circulated through the ozone system 16, the PLC continually monitors the water level in the supply tank and the dissolved ozone concentration of the water in the supply tank. If any of the parameters falls below the desired set point, then the PLC will terminate water circulation from the transfer tank through the ozone system and fill the supply tank or circulate water from the supply tank through the ozone system as necessary. In a preferred embodiment, a series of solenoid valves (32, 34, 36, 38 and 40) direct the flow of water between the water supply, the tanks 12 and 14 and the ozone system 16.

Wash water is delivered to the washers by one or more supply pumps 28 and 44, depending on the number of washers. All supply pumps are controlled via the PLC and will not operate if the dissolved ozone concentration in the supply tank 12 is below the set point. Specifically, if the dissolved ozone falls below the set point, the dissolved ozone monitor will open the circuit for the supply pump forcing it to stop pumping. An operator may adjust the amount of dissolved ozone in the wash water by changing the set points on the dissolved ozone monitor.

Depending upon the configuration of the laundry facility, multiple ozone systems and accordingly sized tanks may be required, as well as multiple water circulation loops. By way of example, a laundry facility operating four 600-pound washers would require multiple ozone systems capable of delivering 600 gallons of ozonated water (i.e., 2.0 3.0 PPM) upon demand (i.e., AJT Tech$_2$ Ozone Model T20P).

As illustrated in FIG. 1, the operator sets the maximum dissolved ozone concentration that may be delivered to the washer or washers directly from supply tank 12. Typically, for normal commercial laundry, the dissolved ozone concentration is set at 2.0 PPM. If, in operation, washing machines 18 (and 22) are washing normal laundry (i.e., not extremely soiled), then upon demand supply pump 28 draws ozonated wash water directly from the supply tank for delivery to the washer via conduit 24. The ozonated wash water is either fed directly into a tunnel washer or via a water supply port 50 and 52 in the case of a single load washer. For ease of discussion, the apparatus and method of the present invention will be discussed in terms of utilizing multiple single load washers. Many commercially available single load washers incorporate two water supply ports. As used herein, water having a dissolved ozone concentration of 0.0 PPM is potable water. Wash water having a dissolved ozone concentration of 1.0 PPM is characterized as having a low concentration, water having a dissolved ozone concentration of 2.0 to 3.0 PPM is characterized as having a medium concentration, and water having a dissolved ozone concentration of greater than 4.5 PPM is characterized as having a high concentration. In use, a water supply delivering make-up water or ozonated water having a low or medium concentration of dissolved ozone is characterized as "cold" (preferably 0.0 to 2.0 PPM). Conversely, a water supply port delivering ozonated water having a higher concentration of dissolved ozone (2.0 to 4.5 PPM) is characterized as "hot." Water supply ports 50, 52 and 70 are cold ports. Water supply ports 60, 62 and 66 are hot ports.

If it is desired to wash a load of heavily soiled laundry in washing machines 18 or 22 or 18 and 22 then, upon demand, ozonated wash water having a high concentration of dissolved ozone is drawn directly from ozone system 16. Specifically, the PLC actuates valves 38 and 54 to deliver wash water straight from ozone system 16 before the water circulates back to the tank. In other words, the water is pumped from supply tank 12, through ozone system 16 where the dissolved ozone concentration is increased, and then delivered to washers 18 or 22 or 18 and 22 via water conduits 56 and 58 through hot water supply ports 60 and 62 of the washers. Therefore, by utilizing both the "hot" and "cold" water supply ports of washers 18 and 22, a dissolved ozone concentration range of 2.0 to greater than 4.5 PPM is achieved.

Similarly, by utilizing both the "hot" and "cold" water supply ports of washers 20, a dissolved ozone concentration range of 0 to 3.0 PPM is achieved.

The innovative idea of using both multiple water supply ports of the washers, combined with the capability of delivering ozonated wash water from either the supply tank or directly from the ozone system, gives this invention its flexibility.

Commercial washers are generally programmable and contain an internal washer controller, hereinafter control means (not shown), which typically controls the introduction of hot and cold water. Each water supply port of a washer has an electrical solenoid valve that is normally closed. When the washer demands water, the washer's controller sends an electrical signal to the solenoid valve to open, thereby filling the water (and conversely closing the solenoid valve when the washer is full). The present system uses the washer's control means to deliver the desired amount of dissolved ozone to the washer upon demand. The apparatus and method of the present system could also incorporate a flow switch or a pressure switch as a control means to regulate the introduction of ozonated water.

A load of regular laundry could be washing in washer 18 where the ozonated wash water is supplied from the supply tank 12 via conduit 24 and introduced through cold water supply port 50, while a load of heavily soiled laundry could be simultaneously washing in washer 22 where the ozonated water is supplied directly from ozone system 16 (closing valve 34, 36, 40 and opening valve 54) via conduit 58 through hot water supply port 62. Ozonated water may be provided to washers 18 and 22 through both the hot and cold water supply ports, thereby permitting further adjustment of the dissolved ozone concentration of the wash water by the washer's control system for each fill cycle. FIG. 1 further illustrates a configuration whereby a washer 20 (and an additional washer 23) may wash laundry (such as colored laundry) at a dissolved ozone concentration of 3.0 PPM or less. Specifically, in operation, a supply pump delivers ozonated water from supply tank 12 (presumably set in the range of 2.0 PPM) directly via conduits 24 and 64 through hot water supply port 66. If a lower concentration of dissolved ozone is desired, city water or make-up water is delivered via conduit 68 through cold water supply port 70, thereby diluting the concentration of dissolved ozone.

Figure 3:
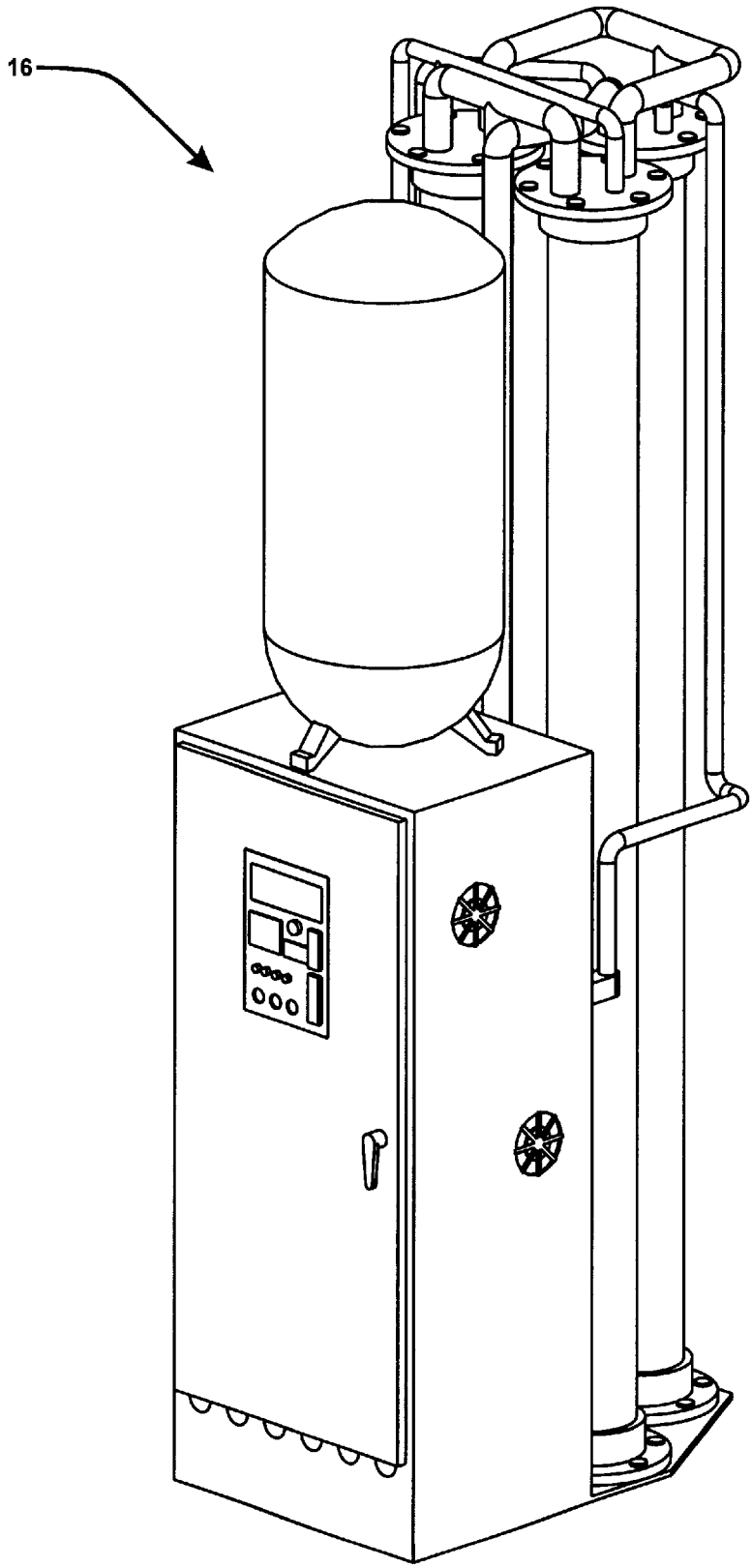

As illustrated in FIG. 3, the ozone system preferably incorporates a plurality of contact columns sized to ensure a minimum contact or dwell time within the columns. Each contact column is an elongate hollow enclosure having a closed top, a closed bottom, and a gas tight hollow interior. An ozone generator is disposed between the water source and said plurality of contact columns whereby ozone is introduced into the water flow. Furthermore, an ozone source is connected in fluid communication with said plurality of contact columns. In operation, any off gas from the ozone system is directed into transfer tank 14 thereby increasing the efficiency of the apparatus and system. The ozone system of the present invention incorporates a supply pump (not shown) which draws feed water from a source. The water then passes through a valve or water flow adjustment means. Any commercially available water pump may be used. The flow rate of the water is adjusted to the desired rate by the water flow adjustment means.

One skilled in the art may readily ascertain the required contact time and specific size of the contact columns. Utilizing the following calculations, the ozone generator and water purification system can be readily sized for particular applications. First, the type and general characteristic of the water source (water quality and flow rate) must be analyzed. Then the ozone dosage and contact time required are ascertained. Generally speaking, ozone generator size=flow rate (in gal/min)×0.012×ozone dosage required (in mg/l) equals lbs./day.

In a preferred embodiment, the ozone system utilized in the present invention is capable of attaining 65% or better mass transfer efficiency. If the ozone generator produces 50 g/hr of ozone and the water flow is 50 gallons per minute, then the theoretical dissolved ozone concentration (PPM) equals:2550×1000/(50×3.785×60)=4.40 PPM of dissolved ozone.

However, if after testing, the dissolved ozone level is only 3.0 PPM dissolved ozone, then the overall mass transfer efficiency is 3.0 PPM/4.4 PPM=68.2%.

The apparatus and method of the present invention may be readily sized based in part upon the capacity of the washer(s) (pounds) and the number of washers. The present system may optionally include the use of water softeners to remove hardness from the local water supply.

In a further refinement, the supply and transfer tanks incorporate a plurality of level switches (72, 74, 76, 78, and 80). Both tanks 12 and 14 incorporate upper 78, 74 and middle 80, 76 switches. Supply tank 12 additionally incorporates lower switch 82. The upper and middle switches aid in filling the tank(s). Assuming upon start-up that both of the tanks are full, as water is withdrawn the water level in the tanks drops. When the water level reaches the middle switches 80 of tank 12 and 76 of tank 14, the tank starts filling until the water level reaches the top switches. Lower switch 82 ensures that the supply tank will not inadvertently empty which could cause the supply pump(s) to run empty and lose prime.

The unique configuration and efficiency of the ozone system of the apparatus of the present invention permits flexibility in setting the desired dissolved ozone concentration and permits the simultaneous delivery of different dissolved ozone concentrations to multiple washers. Once the operator sets the desired concentration, it will be maintained continually by the system so long as the system is in operation. If for some reason the operator needs to adjust to a higher or lower level of dissolved ozone, it can be done readily and the system will achieve the new dissolved ozone concentration in a matter of minutes. Via the PLC, the present invention provides the ability to continuously monitor the concentration of the dissolved ozone being delivered to the washing machine(s). As a safety feature, in use the apparatus and method of the present invention will deactivate the washing machine's supply pump if the concentration of dissolved ozone is below the operator's set point.

The present disclosure includes that contained in the appended claims, as well as that of the foregoing description. Although this invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. Now that the invention has been described,

What is claimed is:

1. An apparatus for treatment of laundry with ozone, said apparatus comprising:

a supply tank and a transfer tank, each of said tanks having a hollow interior and each of said tanks having a water inlet and a water outlet;

a water source connected in fluid communication with said tanks;

means for filling said supply tank and said transfer tank with water from said water source;

an ozone system for generating ozone and dissolving said ozone into water, said ozone system disposed between said water source and said supply tank in fluid communication with said supply tank wherein said ozone generated by said ozone system is introduced into a wash water flow to provide wash water having a dissolved ozone concentration to said supply tank;

a control means for controlling an amount of ozone generated by said ozone system;

a dissolved ozone concentration monitor disposed within said supply tank to determine the dissolved ozone concentration of the wash water;

an oxidation reduction potential monitor disposed within said transfer tank;

means for circulating water in said supply tank between said supply tank and said ozone system until said water in said supply tank has reached a predetermined dissolved ozone concentration;

means for circulating water in said transfer tank between said transfer tank and said ozone system until said water in said transfer tank has reached a predetermined oxidation reduction potential;

at least one washing means in fluid communication with said supply tank and said ozone system;

said at least one washing means including a plurality of wash water supply ports;

whereby wash water having a desired dissolved ozone concentration is delivered to said washing means.

2. The apparatus for treatment of laundry with ozone as in claim 1, wherein the dissolved ozone concentration is between 0.0 PPM and 6.0 PPM.

3. A The apparatus for treatment of laundry with ozone as in claim 1, wherein the dissolved ozone concentration is between 1.0 PPM and 4.5 PPM.

4. The apparatus for treatment of laundry with ozone as in claim 1, wherein said control means is a Programmable Logic Controller.

5. The apparatus for treatment of laundry with ozone as in claim 1, wherein the ozone system further comprises a plurality of contact columns wherein each contact column is an elongate hollow enclosure having a closed top, a closed bottom, and a gas tight hollow interior and wherein an ozone generator is disposed between the water source and said plurality of contact columns whereby ozone is introduced into the water flow.

6. The apparatus for treatment of laundry with ozone as in claim 1, wherein said plurality of wash water supply ports further comprises a first wash water supply port which is cold and a second wash water supply port which is hot.

7. A method for treatment of laundry with ozone, comprising the steps of:

providing a supply tank and a transfer tank in fluid communication with one another;

connecting a source of water to said supply tank and said transfer tank;

filling said supply tank and said transfer tank with water from said water source; providing an ozone generator for generating ozone and positioning said ozone generator between said water source and said supply tank in fluid communication with said supply tank so that ozone generated by said ozone generator is introduced into a wash water flow to provide wash water having a dissolved ozone concentration to said supply tank;

controlling an amount of ozone generated by said ozone generator;

monitoring a dissolved ozone concentration of water in said supply tank;

monitoring an oxidation reduction potential of water in said transfer tank;

circulating water in said supply tank between said supply tank and said ozone generator until said water in said supply tank has reached a predetermined dissolved ozone concentration;

circulating water in said transfer tank between said transfer tank and said ozone generator until said water in said transfer tank has reached a predetermined oxidation reduction potential;

connecting at least one washing means, having a plurality of wash water supply ports, in fluid communication with said supply tank and said ozone generator;

whereby wash water having a preselected dissolved ozone concentration and a preselected ozone oxidation potential is delivered to said washing means.

* * * * *